US010188959B2

(12) United States Patent
Cherednichenko et al.

(10) Patent No.: US 10,188,959 B2
(45) Date of Patent: Jan. 29, 2019

(54) TOY TRACK SETS

(71) Applicant: Mattel, Inc., El Segundo, CA (US)

(72) Inventors: Andrey Cherednichenko, Los Angeles, CA (US); Kurnia Alim, San Gabriel, CA (US)

(73) Assignee: Mattel, Inc., El Segundo, CA (US)

( * ) Notice: Subject to any disclaimer, the term of this patent is extended or adjusted under 35 U.S.C. 154(b) by 304 days.

(21) Appl. No.: 15/297,025

(22) Filed: Oct. 18, 2016

(65) Prior Publication Data

US 2018/0104608 A1 Apr. 19, 2018

(51) Int. Cl.
*A63H 18/02* (2006.01)

(52) U.S. Cl.
CPC ..... *A63H 18/028* (2013.01); *A63H 18/023* (2013.01)

(58) Field of Classification Search
CPC .... A63H 18/02; A63H 18/021; A63H 18/023; A63H 18/028; B61B 13/10
USPC ..... 238/10 A
See application file for complete search history.

(56) References Cited

U.S. PATENT DOCUMENTS 1,885,662 A 11/1932 Whitehorn
2,565,359 A 8/1951 Dubilier
3,514,895 A 6/1970 Ryan et al.
3,697,071 A * 10/1972 Anderson ..... A63H 18/002 104/155
3,708,116 A 1/1973 Woodward
4,217,727 A 8/1980 Fetty et al.
4,231,294 A 11/1980 Arzoumanian
4,652,248 A 3/1987 Kozuka
5,579,997 A 12/1996 Jackson et al.
6,631,850 B1 10/2003 Wa
7,051,948 B2 5/2006 Wa
7,963,821 B2 6/2011 Ostendorff
8,192,246 B2 6/2012 Ostendorff et al.
8,747,180 B2 6/2014 O'Connor et al.
8,814,628 B2 8/2014 O'Connor et al.
8,845,387 B2 9/2014 Grafton et al.
9,114,323 B2 8/2015 Lennon
9,731,212 B2 * 8/2017 Cheung ..... A63H 18/02
2005/0191938 A1 9/2005 Sheltman et al.
2005/0191940 A1 9/2005 Sheltman et al.
2005/0287917 A1 12/2005 Sheltman et al.
2005/0287919 A1 12/2005 Sheltman et al.
2010/0258060 A1 * 10/2010 Wilson ..... A01K 15/025 119/707

(Continued)

*Primary Examiner* — Zachary L Kuhfuss
(74) *Attorney, Agent, or Firm* — Edell, Shapiro & Finnan, LLC

(57) ABSTRACT

Toy track sets for toy vehicles are disclosed. A toy track set for a toy vehicle may include a first track section having a first travel surface and a first tubular connector at a first connecting end of the first travel surface. The toy track set may further include a second track section that is configured to be rotatably coupled to the first tubular connector. The second track section may include a second travel surface having first and second travel portions. The second track section may be configured to rotate relative to the first track section between a first position in which the first travel surface forms a continuous travel path with the first travel portion, and a second position in which the first travel surface forms a continuous travel path with the second travel portion.

20 Claims, 13 Drawing Sheets

(56) References Cited

U.S. PATENT DOCUMENTS

| | | | | |
|---|---|---|---|---|
| 2013/0324011 | A1 | 12/2013 | O'Connor | |
| 2014/0256220 | A1 | 9/2014 | Lennon | |
| 2015/0097045 | A1 | 4/2015 | Lennon | |
| 2015/0122903 | A1 | 5/2015 | Boyce et al. | |
| 2018/0229136 | A1* | 8/2018 | Cherednichenko .. | A63H 18/023 |

* cited by examiner

200

TOY TRACK SETS

BACKGROUND

People of all ages enjoy playing with toy vehicles on racetracks. Toy vehicles may be enjoyed with accessories, such as a track including curves, loops, jumps, and other features. People of all ages also enjoy children's films, including ones featuring anthropomorphized vehicles. Many toys having the appearance of vehicles and settings from that film are popular with children of all ages.

SUMMARY

In some embodiments, a toy track set for a toy vehicle may include a first track section having a first travel surface and a first tubular connector at a first connecting end of the first travel surface. The toy track set may further include a second track section that is configured to be rotatably coupled to the first tubular connector. The second track section may include a second travel surface having first and second travel portions. The second track section may be configured to rotate relative to the first track section between a first position in which the first travel surface forms a continuous travel path with the first travel portion, and a second position in which the first travel surface forms a continuous travel path with the second travel portion.

In some embodiments, a toy track set for a toy vehicle may include a first track section having a first travel surface and a first cylindrical connector. The toy track set may further include a second track section having a second travel surface and a second cylindrical connector. The second travel surface may include first and second travel portions. The second cylindrical connector may be configured to be rotatably connected to the first cylindrical connector to allow the second track section to rotate relative to the first track section between a first position in which the first travel surface is contiguous with the first travel portion and not contiguous with the second travel portion, and a second position in which the first travel surface is contiguous with the second travel portion and not contiguous with the first travel portion.

Features, functions, and advantages may be achieved independently in various embodiments of the present disclosure, or may be combined in yet other embodiments, further details of which can be seen with reference to the following description and drawings.

DESCRIPTION

Overview

Various embodiments of a toy track set for a toy vehicle are described below and illustrated in the associated drawings. Unless otherwise specified, the toy track set and/or its various components may contain at least one of the structure, components, functionality, and/or variations described, illustrated, and/or incorporated herein. Furthermore, the structures, components, functionalities, and/or variations described, illustrated, and/or incorporated herein in connection with the present teachings may be included in other similar toy track sets. The following description of various embodiments is merely illustrative in nature and is in no way intended to limit the disclosure, its application, or uses. Additionally, the advantages provided by the embodiments, as described below, are illustrative in nature and not all embodiments provide the same advantages or the same degree of advantages.

Examples, Components, and Alternatives

The following sections describe selected aspects of illustrative toy track sets as well as related apparatuses and/or methods. The examples in these sections are intended for illustration and should not be interpreted as limiting the entire scope of the present disclosure. Each section may include one or more distinct inventions, and/or contextual or related information, function, and/or structure.

Figure 1:
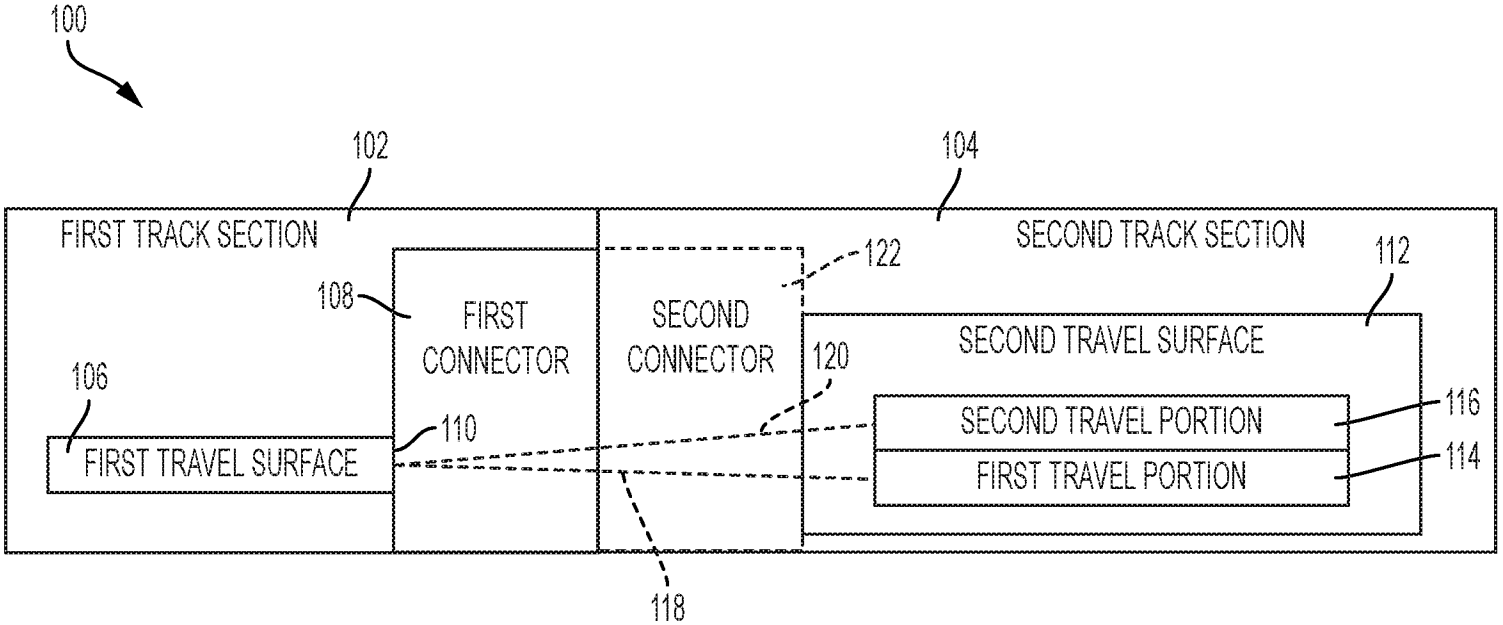
FIG. 1 is a block diagram of an illustrative toy track set for a toy vehicle.

Illustrative Toy Track Set:

This example describes an illustrative toy track set for a toy vehicle having a first track section and a second track section; see FIG. 1.

FIG. 1 is a block diagram of an illustrative toy track set for a toy vehicle, generally indicated at 100. Toy track set 100 may include a first track section 102 and a second track section 104. The first and second track sections may be constructed of any appropriate material or combination of materials, such as wood or injection molded plastic, etc.

First track section 102 may include a first travel surface 106 and a first connector 108, which may be at a first connecting end 110 of first travel surface 106 and/or other suitable portions of the first travel surface. First travel surface 106 may be adapted or configured to support a toy vehicle as it travels across or along that surface. First travel surface may be as wide or wider than a toy vehicle. First travel surface 106 may be planar or may have curvature in one or more directions, for example curvature in a direction parallel to a direction of travel for the toy vehicle, curvature in a direction perpendicular to the direction of travel for the toy vehicle, or both.

First connector 108 may be configured to couple first track section 102 to second track section 104. The connection between the first and second track sections may be a rotatable connection and/or other suitable connection(s). For example, the second track section may be able to rotate relative to the first track section while coupled to the first track section. Upon rotation, the second track section may take a plurality of positions and/or orientations relative to the first track section. The first and second track sections may be said to be rotatably coupled to one another. First connector 108 may, in some embodiments, be a first tubular connector and/or a first cylindrical connector.

Second track section 104 may be configured to be rotatably coupled to first connector 108. Second track section 104 may include a second travel surface 112. Second travel surface 112 may include a first travel portion 114 and a second travel portion 116. Second track section 104 may be configured to rotate relative to first track section 102 between a first position in which first travel surface 106 forms a continuous travel path, indicated at dashed line 118, with first travel portion 114, and a second position in which first travel surface 106 forms a continuous travel path, indicated at dashed line 120, with second travel portion 116.

When second track section 104 is in the first position relative to first track section 102, a toy vehicle may travel from first travel surface 106 to first travel portion 114 without intervention from a user of toy track set 100. In some examples, if a toy vehicle had been traveling along the first travel surface, perhaps having previously been imparted with some kinetic energy, the toy vehicle may then proceed to travel along the first travel portion 114 of the second travel surface 112, without the need of additional kinetic energy, when the second track section is in the first position. That is, first travel surface 106 and first travel portion 114 may both be part of continuous travel path 118 when the second track section is in the first position.

When the second track section is in the first position relative to the first track section, first travel surface 106 may be contiguous with first travel portion 114 of the second travel surface 112. Further, when the second track section is in the first position relative to the first track section, first travel surface 106 may not be contiguous with second travel portion 116 of the second travel surface 112. That is, a toy vehicle traveling from first travel surface 106 toward second travel surface 112 may subsequently travel along the first travel portion 114 and not along the second travel portion 116 when the second track section is in the first position, without intervention from a user.

When second track section 104 is in the second position relative to first track section 102, a toy vehicle may travel from first travel surface 106 to second travel portion 116 without intervention from a user of toy track set 100. In some examples, if a toy vehicle had been traveling along the first travel surface, perhaps having previously been imparted with some kinetic energy, the toy vehicle may then naturally proceed to travel along the second travel portion 116 of the second travel surface 112, without the need of additional kinetic energy, when the second track section is in the second position. That is, first travel surface 106 and second travel portion 116 may both be part of continuous travel path 120 when the second track section is in the second position.

When the second track section is in the second position relative to the first track section, first travel surface 106 may be contiguous with second travel portion 116 of the second travel surface 112. Further, when the second track section is in the second position relative to the first track section, first travel surface 106 may not be contiguous with first travel portion 114 of the second travel surface 112. That is, a toy vehicle traveling from first travel surface 106 toward second travel surface 112 may subsequently travel along the second travel portion 116 and not along the first travel portion 114 when the second track section is in the second position, without intervention from a user.

First travel portion 114 and second travel portion 116 may, in some examples, be parallel or generally parallel to each other. In some examples, second travel surface 112 may be a curved surface and either or both of the first and second travel portions of the second travel surface may have curvature. In such a curved environment, the first and second travel portions may be parallel in the sense that it may be the case that a first reference trajectory contained within the first travel portion and a second reference trajectory contained within the second travel portion do not cross. It may be the case that a shortest distance between the first and second reference trajectories remains constant along the length of either or both of the first and second reference trajectories. In other examples, the first and second travel portions may be non-parallel to each other, such as when the first and second travel portions extend away from each other, as in a fork in a road.

Second track section 104 may include a second connector 122 at a second connecting end 124 of second travel surface 112 and/or at other suitable portions of the second travel surface. Second connector 122 may be configured to be rotatably coupled to first track section 102. In some examples, the second connector may be configured to be rotatably coupled to first connector 108 of the first track section. Second connector 122 may, in some embodiments, be a second tubular connector and/or a second cylindrical connector.

In some examples, first connector 108 and second connector 122 may fit together as an inner sleeve received within an outer sleeve. The first connector may be the inner sleeve and the second connector may be the outer sleeve, or vice-versa. In some examples, the rotatable connection(s) made between the connectors in the present disclosure may be referred to as "rotatable coupling(s)."

In examples where one or both of the first and second connectors 108 and 122 are a cylindrical connector, the first and second cylindrical connectors may share a common axis of rotation. That is, one of the first and second cylindrical connectors may rotate relative to the other of the first and second cylindrical connectors by rotating about the common rotation axis. This rotation may be performed without decoupling the first cylindrical connector from the second cylindrical connector. The common axis of rotation may be parallel to a direction of travel of a toy vehicle through the first and second cylindrical connectors. The common rotation axis may be generally parallel to an adjacent section of any of first travel surface 106, first travel portion 114, and second travel portion 116.

Embodiment of a Toy Track Set in a Vertical Orientation:

This example describes an illustrative toy track set for a toy vehicle having a first track section and a second track section, with the second track section in a generally vertical orientation; see FIGS. 2-8.

Figure 2:
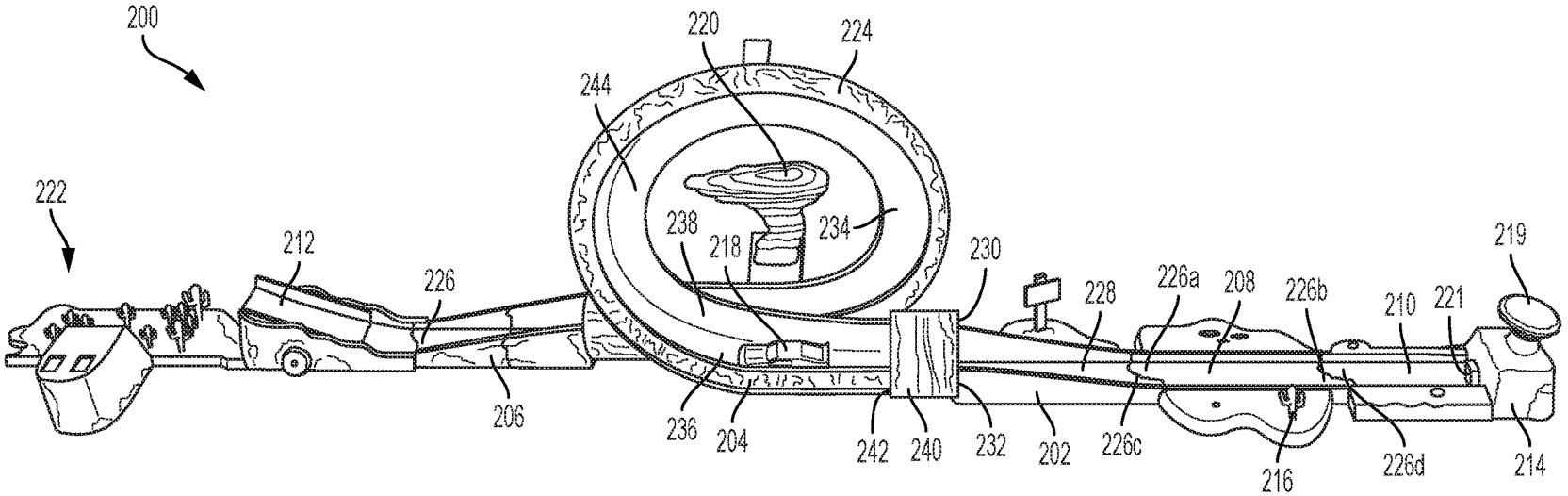
FIG. 2 is a perspective view of an embodiment of toy track set for a toy vehicle of FIG. 1, showing a loop in a generally vertical orientation.

FIG. 2 is a perspective view of an embodiment of a toy track set for a toy vehicle, generally indicated at 200. Toy track set 200 is an embodiment of toy track set 100, and the various features and benefits of toy track set 100 will not be repeated in their entirety. Toy track set 200 may include a first track section 202 and a second track section 204.

Toy track set 200 may include other track sections, such as a third track section 206, a fourth track section 208, a fifth track section 210, and a sixth track section 212, among others. Fourth track section 208 may include, for example, a flat section of track. Fifth track section 210 may include, for example, a flat section of track. Sixth track section 212 may include, for example, a ramp section of track.

The track set may include various components, such as a vehicle launcher or booster 214, and decorative elements intended to invoke a certain landscape or setting, such as a representation of a cactus 216. In some embodiments, toy track set 200 may include a toy vehicle 218, while in other embodiments the track sections may be sized and/or configured to accommodate other toy vehicles such as HOT WHEELS® or MATCHBOX® die cast toy vehicles.

Launcher 214 may include an actuator 219 and a striker 221. Launcher 214 may be configured so that when actuator 219 is actuated by a user, and toy vehicle 218 is positioned proximate striker 221, striker 221 may impart the toy vehicle with enough kinetic energy to travel along the toy track set 200. Striker 221 may be configured to give the toy vehicle sufficient kinetic energy to travel from the first track section 202 to the second track section 204 and on to the third track section 206. The toy vehicle may have sufficient kinetic energy to traverse the second track section while maintaining or nearly maintaining contact with the second track section. Actuator 219 may be a button and may be configured to move up and down, while striker 221 may be configured to move in a horizontal direction. In some examples, an exit speed of the toy vehicle from launcher 214 may depend upon the force applied to actuator 219.

Toy track set 200 may be designed or configured to resemble a setting from popular films with a theme of racing. Toy track set 200 may include a representation of particular distinguishing landmarks from the setting, such as butte 220, as well as more general desert landscape items, such as a representation of a group of cacti 222, and decorative surfaces 224 of toy track set 200 which may have the appearance of desert rocks.

One or more of the track sections may have one or more modular connection ends 226 configured to couple with any of the modular connection ends of another of the track sections. For example, fourth track section 208 may have a first modular connection end 226*a* opposite a second modular connection end 226*b*. In the configuration shown in FIG. 2, the first modular connection end 226*a* of fourth track section 208 is coupled to a third modular connection end 226*c* of first track section 202, while the second modular connection end 226*b* of the fourth track section is coupled to a fourth modular connection end 226*d* of fifth track section 210. Many different configurations of toy track set 200 are possible by omitting track sections, adding additional track sections, or by connecting the various track sections together in a different order than that shown in FIG. 2.

First track section 202 may have a first travel surface 228 and a first tubular or cylindrical connector 230 at a first connecting end 232 of the first travel surface. Second track section 204 may have a second travel surface 234 having a first travel portion 236 and a second travel portion 238. Second track section 204 may have a second tubular or cylindrical connector 240 at a second connecting end 242 of second travel surface 234. Second tubular connector 240 may be configured to be rotatably coupled to first tubular connector 230. Second track section 204 may have a first position (shown, for example, in FIG. 2) relative to first track section 202 as described above in reference to FIG. 1. Second track section 204 may have a second position (shown, for example, in FIG. 9) as described above in reference to FIG. 1.

Second travel surface 234 may form a loop 244 that is in a generally vertical or upright orientation in the first position. Vehicle launcher 214 may impart sufficient speed to toy vehicle 218 that the vehicle may traverse fifth track section 210, fourth track section 208, first track section 202, the first travel portion 236 of second track section 204, third track section 206, and sixth track section 212, perhaps with enough speed left over at the end to jump over the group of cacti 222. Toy vehicle 218 may have enough kinetic energy to maintain or nearly maintain contact with the first travel portion of the second track section in the generally vertical orientation even as the toy vehicle becomes upside down at a top end of the vertically-oriented loop 244.

Figure 3:
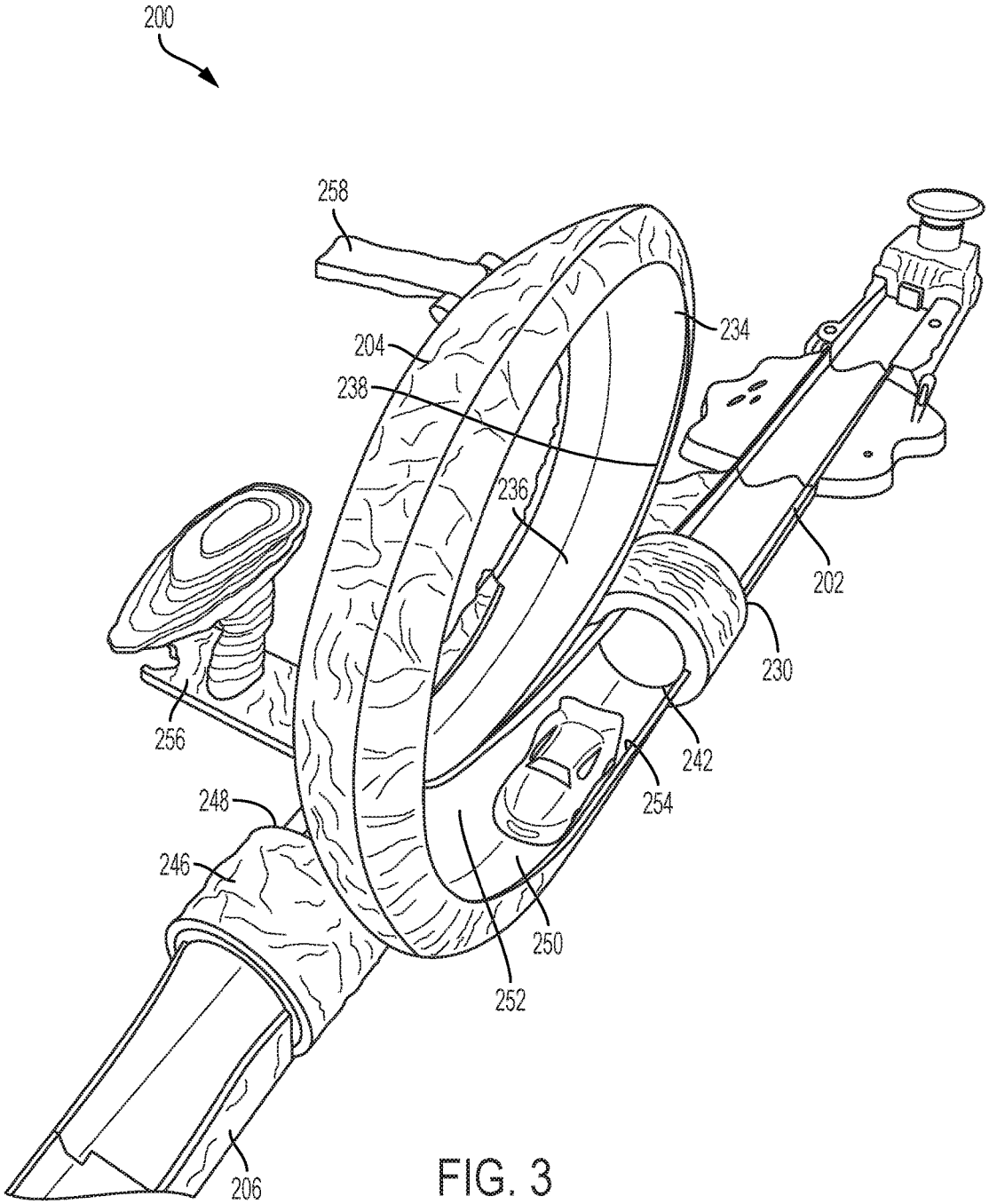
FIG. 3 is another perspective view of the toy track set of FIG. 2.

FIG. 3 is another perspective view of toy track set 200. Second track section 204 may be configured to be rotatably coupled to first tubular connector 230 of first track section 202 as described above in reference to FIG. 1. Second track section 204 may further include a third tubular or cylindrical connector 246 at a third connecting end 248 of second travel surface 234. Third connecting end 248 may be opposed from second connecting end 242. Third track section 206 may be configured to be rotatably coupled to third tubular connector 246. Third track section 206 may be configured to be rotatably coupled to second track section 204 in much the same manner as first track section 202 is configured to be rotatably coupled to the second track section.

Second travel surface 234 may have a generally concave shape with a bottom portion 250, a first curved embankment or portion 252, and a second curved embankment or portion 254. The bottom portion may be disposed between the first and second curved portions. The first curved embankment may extend farther from the bottom portion than does the second curved embankment extend from the bottom portion. In some embodiments, first travel portion 236 may be along bottom portion 250 and second travel portion 238 may be along the first curved portion 252.

Second track section 204 may include a transverse support member 256 which may provide a measure of stability to loop 244 when in the vertical orientation. Transverse support member 256 may have a dimension generally perpendicular to a direction of travel of a toy vehicle traveling on first travel portion 236. Second track section 204 may further include a second support member 258 which may provide a measure of stability to loop 244 when in the generally horizontal orientation, see for example in FIG. 10.

Figure 4:
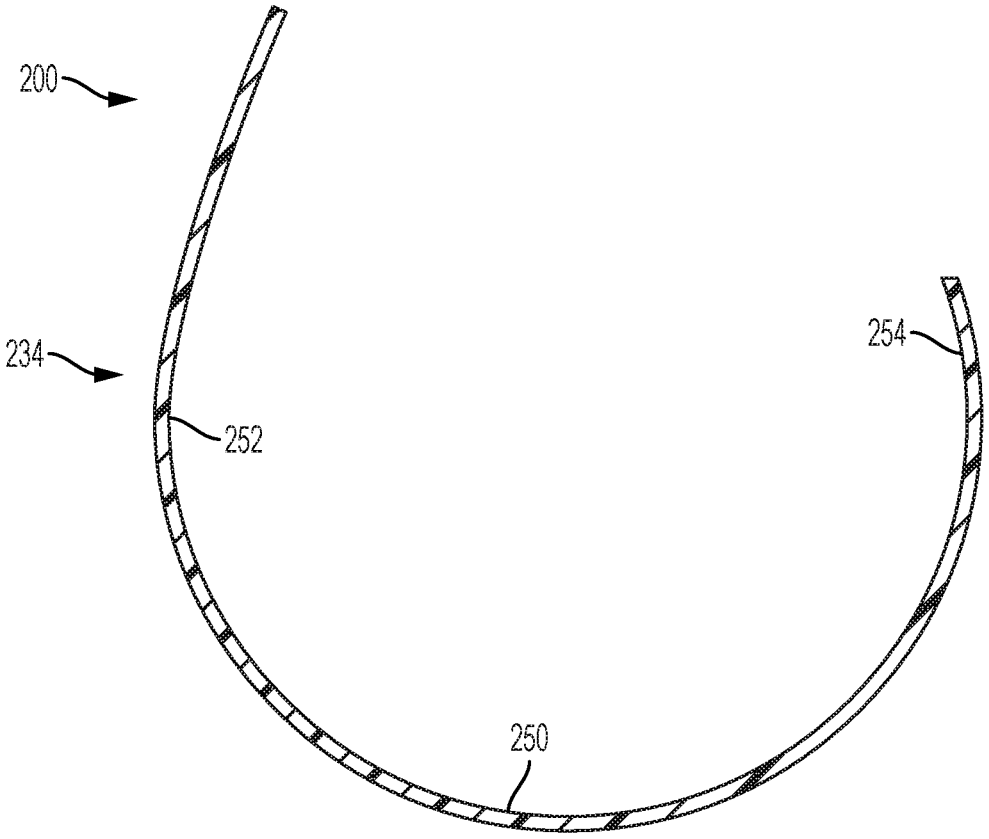
FIG. 4 is a cross-sectional view of the loop section of the toy track set of FIG. 2.

FIG. 4 shows a lateral cross section of second travel surface 234, showing bottom portion 250 and the two curved portions 252 and 254. The lateral cross section of second travel surface 234 is concave-shaped, though not necessarily forming a portion of a circle. That is, the curvature of the second travel surface in directions perpendicular to the direction of travel of a toy vehicle may not be constant around the second travel surface. The bottom portion may be the lowest portion of loop 244 proximate a bottom end of the loop and may be the highest portion of the loop proximate a top end of the loop, when the loop is in the generally vertical orientation. When loop 244 is in the generally horizontal orientation, the first curved portion 252 may be the lowest portion of the loop, see for example in FIG. 10.

Figure 5:
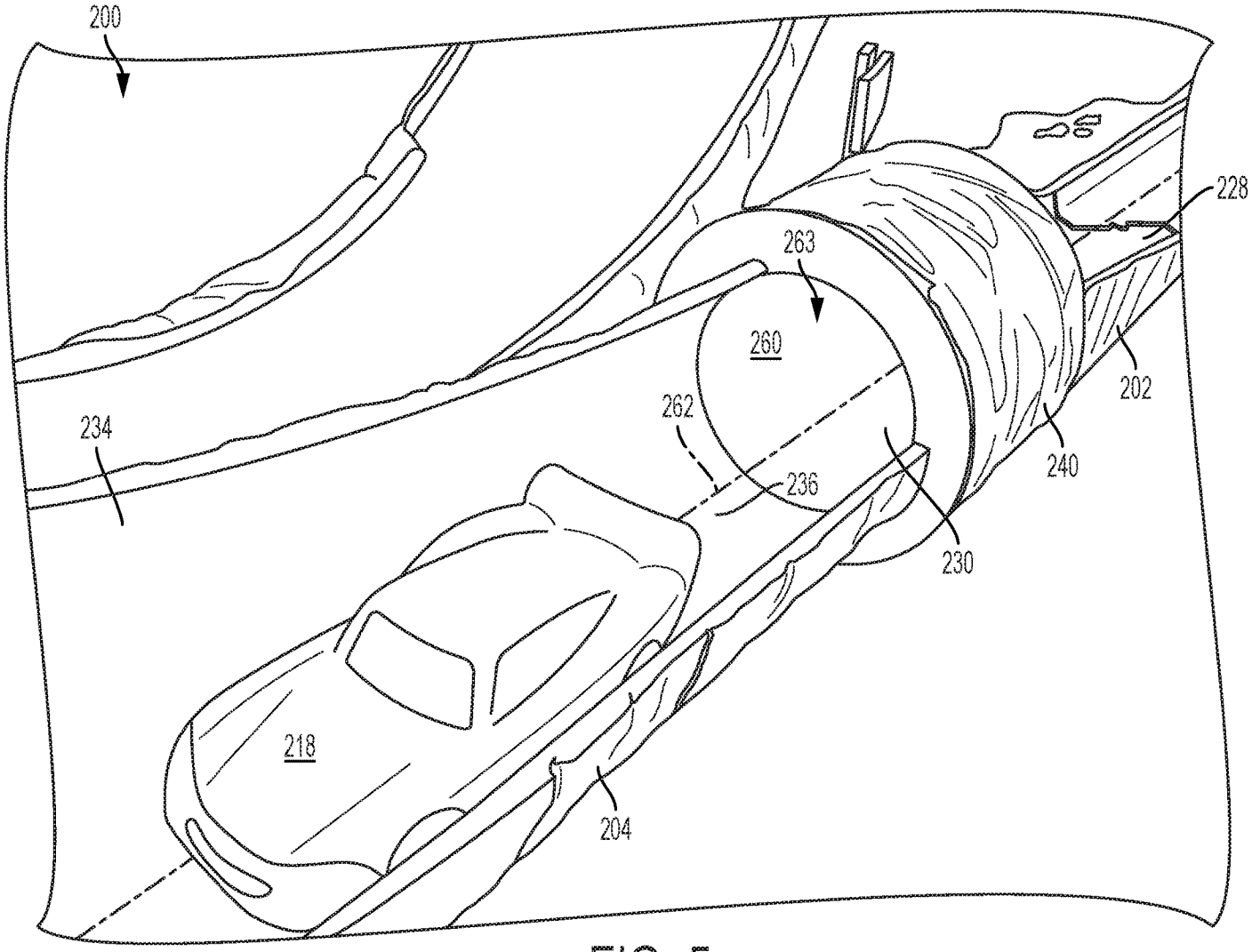
FIG. 5 is a perspective view of the toy track set of FIG. 2, showing a connection between a first track section and a second track section.

FIG. 5 is a detailed perspective view of the connection between first track section 202 and second track section 204. First tubular connector 230 may include an inner surface 260 that is contiguous with first travel surface 228. Inner surface 260 may form a continuous travel path 262 with first travel surface 228 and first travel portion 236 of second travel surface 234 in the first position. Toy vehicle 218 may travel along continuous travel path 262 under its own momentum from the first travel surface, along the inner surface of the first tubular connector, and to the first travel portion of the second travel surface.

Second tubular connector 240 may have one opening 263. Second travel surface 234 may, in some embodiments, engage with at least 180 degrees of opening 263. That is, the line of connection between the second travel surface and the second tubular opening may include half or more than half of a full circle.

Figure 6:
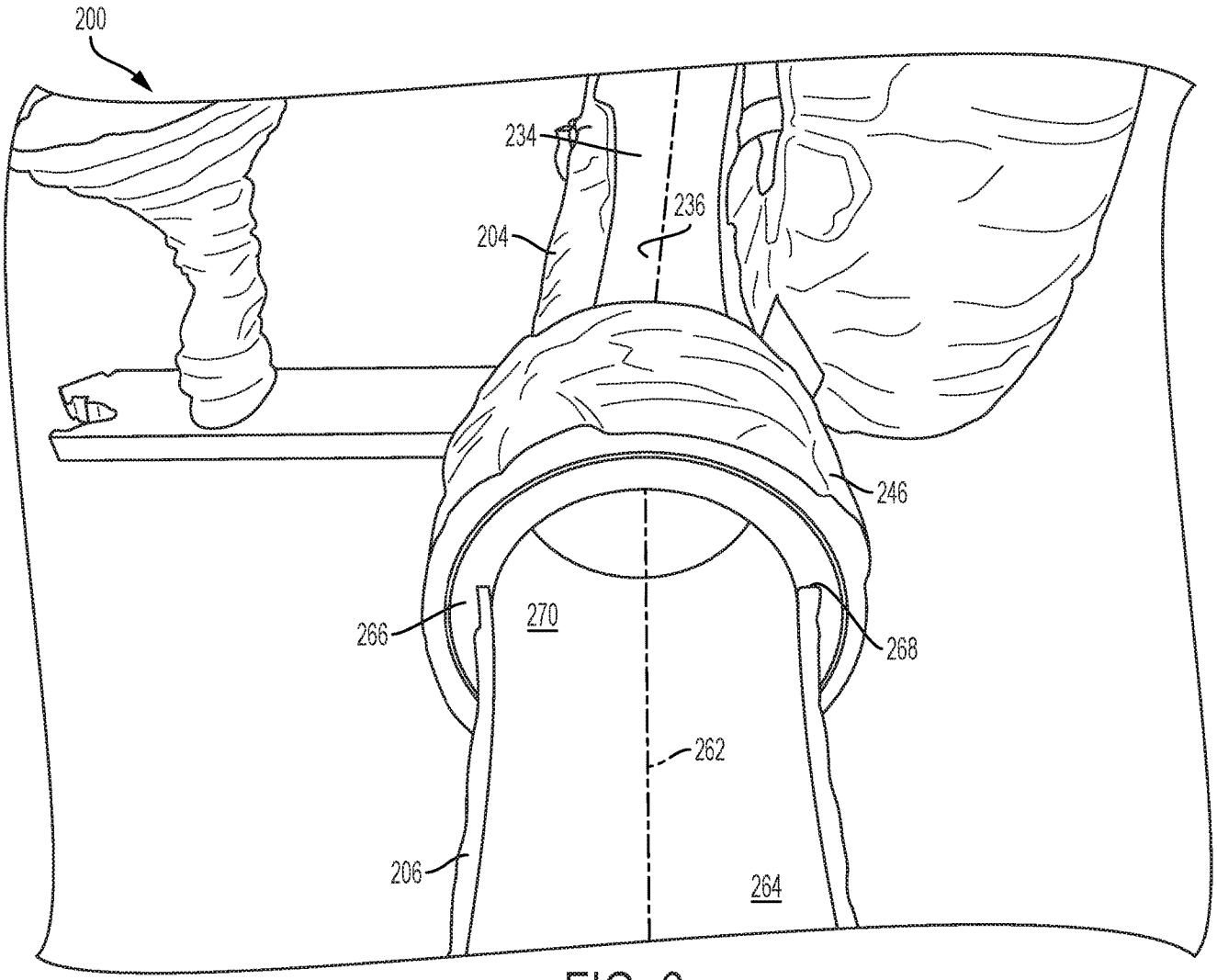
FIG. 6 is a perspective view of the toy track set of FIG. 2, showing a connection between the second track section and a third track section.

FIG. 6 is a detailed perspective view of the connection between second track section 204 and third track section 206. Third track section 206 may include a third travel surface 264 and a fourth tubular or cylindrical connector 266 at a fourth connecting end 268 of third travel surface 264. The fourth tubular connector 266 may be configured to be rotatably coupled to the third tubular connector 246 of the second track section 204. Fourth tubular connector 266 may have the same configuration as the first tubular connector 230, so that either or both of the first and fourth tubular connectors may be rotatably coupled to either of both of the second and third tubular connectors of the second track sections.

The continuous travel path 262 may extend from first travel portion 236 of second track section 204 along an inner surface 270 of the fourth tubular connector 266. That is, third travel surface 264 may form continuous travel path 262 with first travel surface 228 (shown in FIG. 5), inner surface 260 of first tubular connector 230 (shown in FIG. 5), and first travel portion 236 of second travel surface 234 when the second track section is in the first position. Third travel surface 264 may be contiguous with the first travel portion in the first position.

Figure 7:
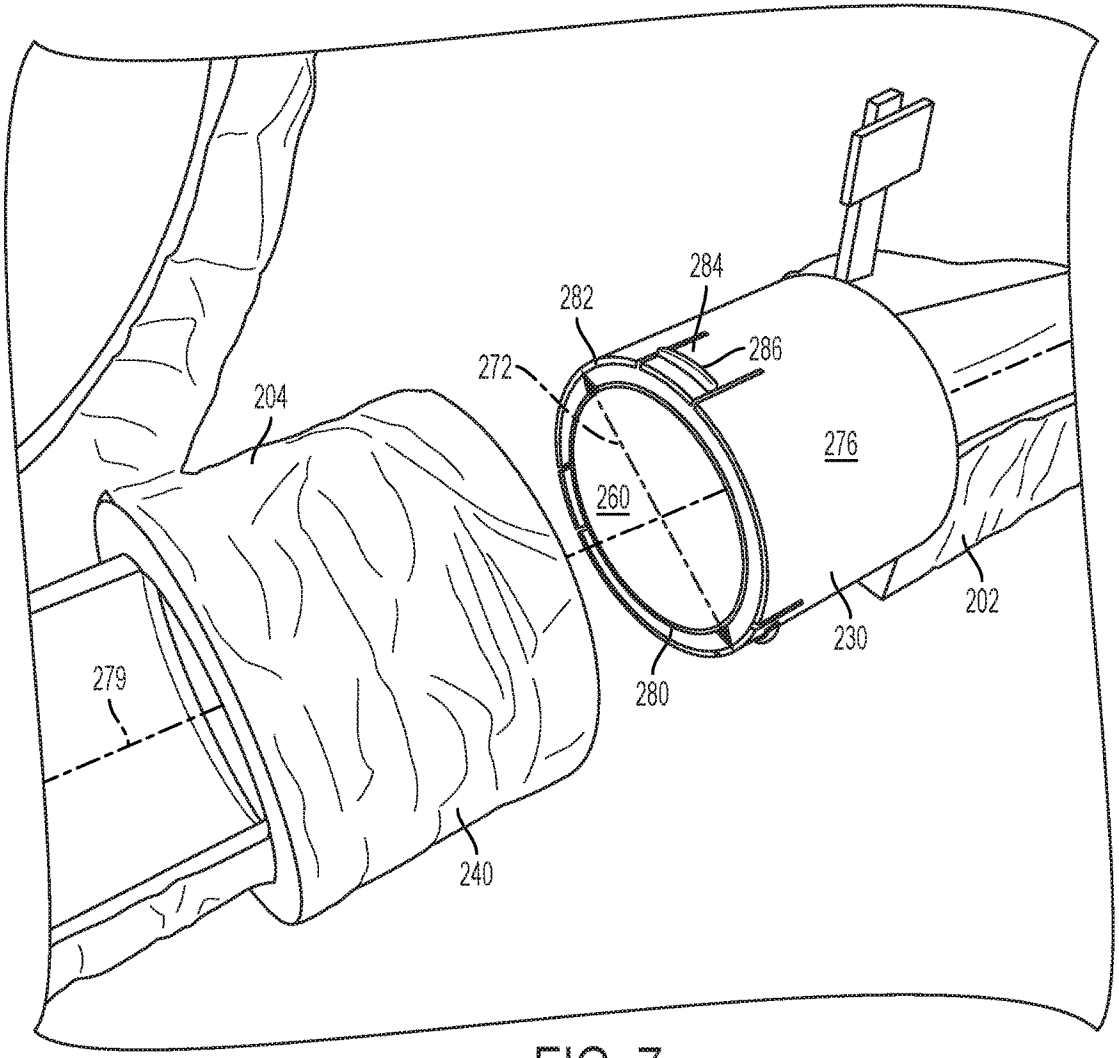
FIG. 7 is a perspective view of the toy track set of FIG. 2, showing the first track section disconnected from the second track section.
Figure 8:
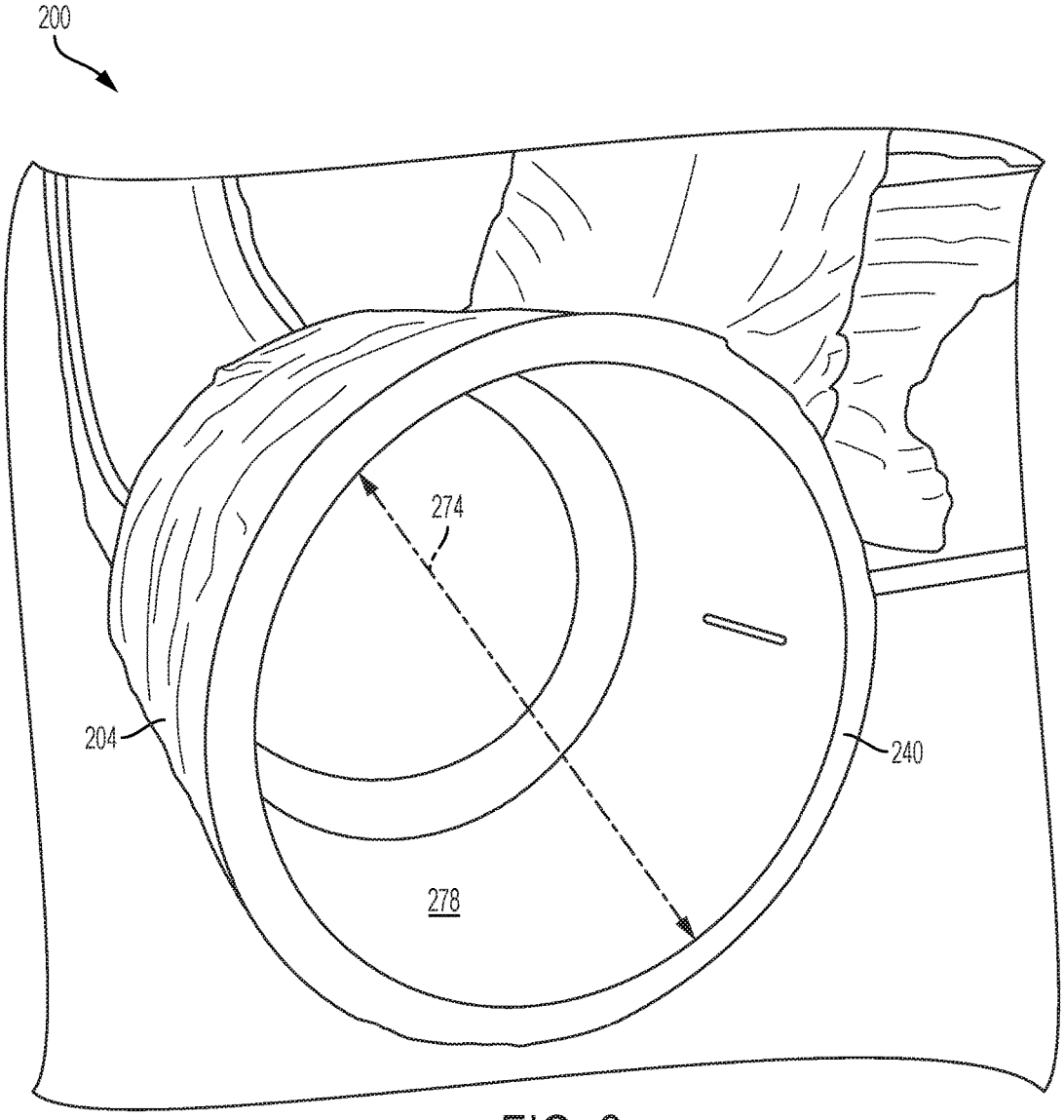
FIG. 8 is a perspective view of the toy track set of FIG. 2, showing a connecting end of the second track section.

FIG. 7 is a detailed perspective view of toy track set 200, showing first track section 202 not coupled to, or disconnected from, second track section 204. FIG. 8 is a detailed perspective view of toy track set 200, showing second tubular connector 240 of the second track section. FIGS. 7 and 8 are herein described together.

First tubular or cylindrical connector 230 and second tubular or cylindrical connector 240 may be configured for frictional engagement with each other when the second tubular connector is rotatably coupled or connected to the first tubular connector. First tubular connector 230 may have a first diameter 272 and second tubular connector 240 may have a second diameter 274. The first diameter may be different than the second diameter to allow one of the first and second cylindrical connectors 230 and 240 to be received in the other of the first and second cylindrical connectors.

In the embodiment shown in FIGS. 7 and 8, first diameter 272 is an outer diameter of first tubular connector 230 and second diameter 274 is an inner diameter of second tubular connector 240. The first diameter may be less than the second diameter such that the first tubular connector is sized to be received within the second tubular connector. That is, first tubular connector 230 may function as an inner sleeve and second tubular connector 240 may function as an outer sleeve, as described above. The first diameter may be only slightly less than the second diameter such that an outer surface 276 of first tubular connector 230 makes frictional contact with an inner surface 278 of second tubular connector 240 when the first tubular connector is received within the second tubular connector.

First tubular connector 230 and second tubular connector 240 may share a common axis of rotation 279 as described above. The first tubular connector may be received by the second tubular connector by moving the first tubular connector toward the second tubular connector along the common axis of rotation. Once the first tubular connector is received within the second tubular connector, the first and second tubular connectors may rotate relative to one another about their common axis of rotation.

In some examples, first tubular connector 230 may have a double-walled structure, where an inner wall 280 of the first tubular connector includes the inner surface 260 and an outer wall 282 of the first tubular connector includes the outer surface 276. Outer wall 282 may include one or more flexible tabs 284 which may be configured to flex toward the inner wall when the first tubular connector is received within second tubular connector 240. The flexing of tabs 284 may provide a contact force between the first and second tubular connectors which may inhibit relative rotation or separation of the first and second track sections 202 and 204. One or more of the one or more flexible tabs may include a rib 286 which may fit within a corresponding groove within the second tubular connector or simply engage with inner surface 278 of the second tubular connector.

In some embodiments, the structures of the first and second tubular connectors 230 and 240 may be switched between the first and second track portions 202 and 204. That is, the first track portion 202 may include the second tubular connector 240 as described herein and the second track portion 204 may include the first tubular connector 230 as described herein. In these examples, the tubular connector of the second track section may be received within the tubular connector of the first track section. Although the first, second, and third track sections of toy track set 200 are shown to include tubular or cylindrical connectors, one or more of the other track sections may additionally, or alternatively, include tubular or cylindrical connectors.

Embodiment of a Toy Track Set in a Horizontal Orientation:

This example describes toy track set 200 with the second track section 204 in a generally horizontal orientation; see FIGS. 9-13.

Figure 9:
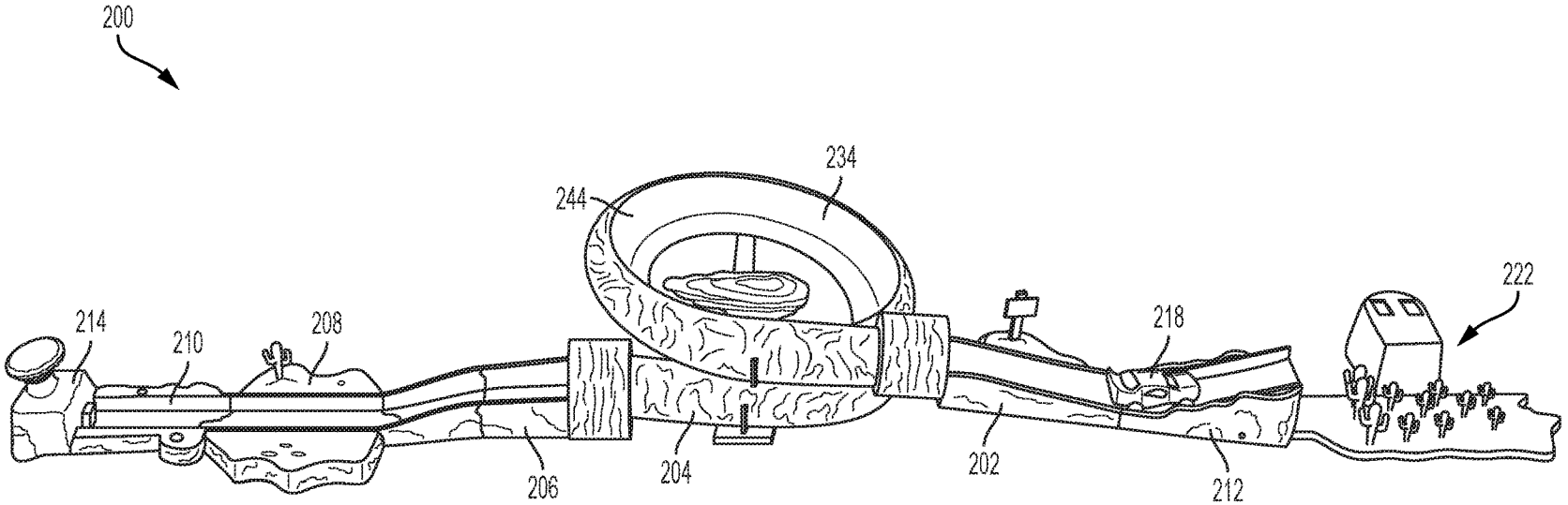
FIG. 9 is a perspective view of the toy track set of FIG. 2, showing the loop in a generally horizontal orientation.

FIG. 9 is a perspective view of toy track set 200 including first track section 202 and second track section 204. The configuration of toy track set 200 shown in FIG. 9 has at least two differences from the configuration of toy track set 200 shown in FIG. 2. First, in FIG. 9, loop 244 formed by second travel surface 234 is in a generally horizontal orientation and is in the second position as described in reference to FIG. 1. Second, the fourth track section 208, fifth track section 210, sixth track section 212, vehicle launcher 214 and group of cacti 222 as shown in FIG. 9 are in a different relative configuration than that shown in FIG. 2. However, it will be appreciated that first track section 202, second track section 204 and third track section 206 as shown in FIG. 9 have a similar relative configuration as shown in FIG. 2, with the exception of the change in orientation of loop 244. It will further be appreciated that the toy vehicle 218, when given an initial speed by vehicle launcher 214, may travel through second track section 204 in an opposite direction than that indicated by FIG. 2.

Figure 10:
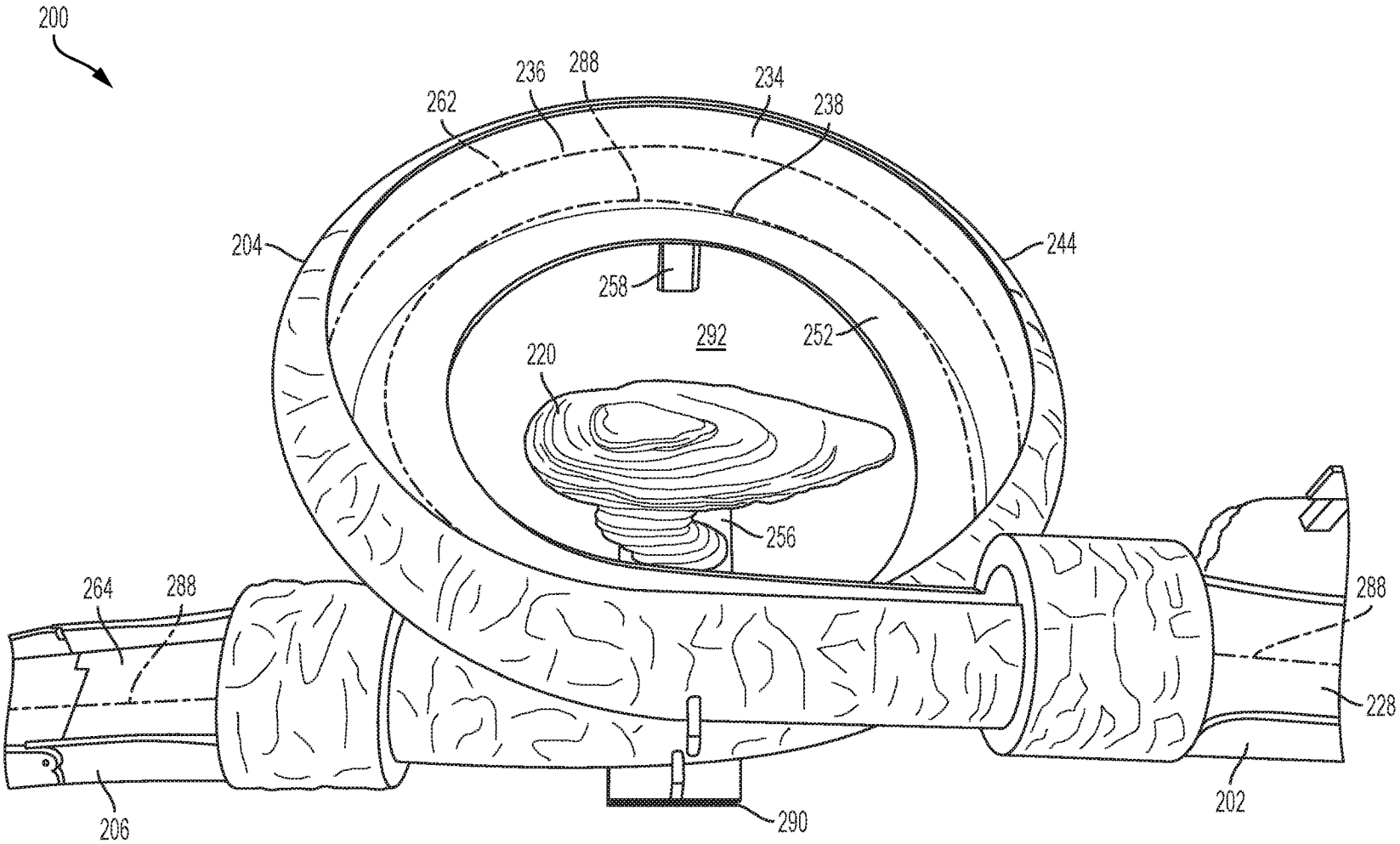
FIG. 10 is a perspective view of the toy track set of FIG. 9, showing a first travel portion and a second travel portion.

FIG. 10 is another perspective view of toy track set 200 with second track section 204 in the second position. In the second position, first travel surface 228 of first track section 202 may form a continuous travel path 288 with second travel portion 238 of second travel surface 234 of the second track section. Second travel portion 238 may be along one of the two curved portions of the second travel surface, for example, first curved portion 252. Continuous travel path 288 may continue to third travel surface 264 of third track section 206.

It will be appreciated that continuous travel path 262, i.e. the path included in the first travel portion 236 of second travel surface 234 that may be traveled by a toy vehicle when loop 244 is in the vertical orientation, may be offset from continuous travel path 288. When second track section 204 is in the generally horizontal orientation, second travel surface 234 may be considered a "banked travel surface," where the second travel surface is angled inward to counteract the outward centrifugal forces acting on a toy vehicle as it travels around the horizontal loop 244.

When track section 204 is in the second position, loop 244 may be supported, at least in part, by second support member 258. Loop 244 may be supported, at least in part, by transverse support member 256. Second track section 204 may be coupled to transverse support member 256 by a hinge 290. Hinge 290 may allow the transverse support member to provide stability to the second track section when the second track section is in either or both of the first position and the second position.

When second track section 204 is in the second position, decorative element butte 220 may be disposed within an area 292 enclosed by the horizontally-oriented loop 244. Thus, a toy vehicle may traverse continuous travel path 288 and make a loop around the butte 220 to simulate an action sequence from the film. Butte 220 may be a rotatable decorative element, as can be seen by the change in orientation of the butte 220 shown in FIG. 10 relative to the orientation shown in FIG. 9.

Figure 11:
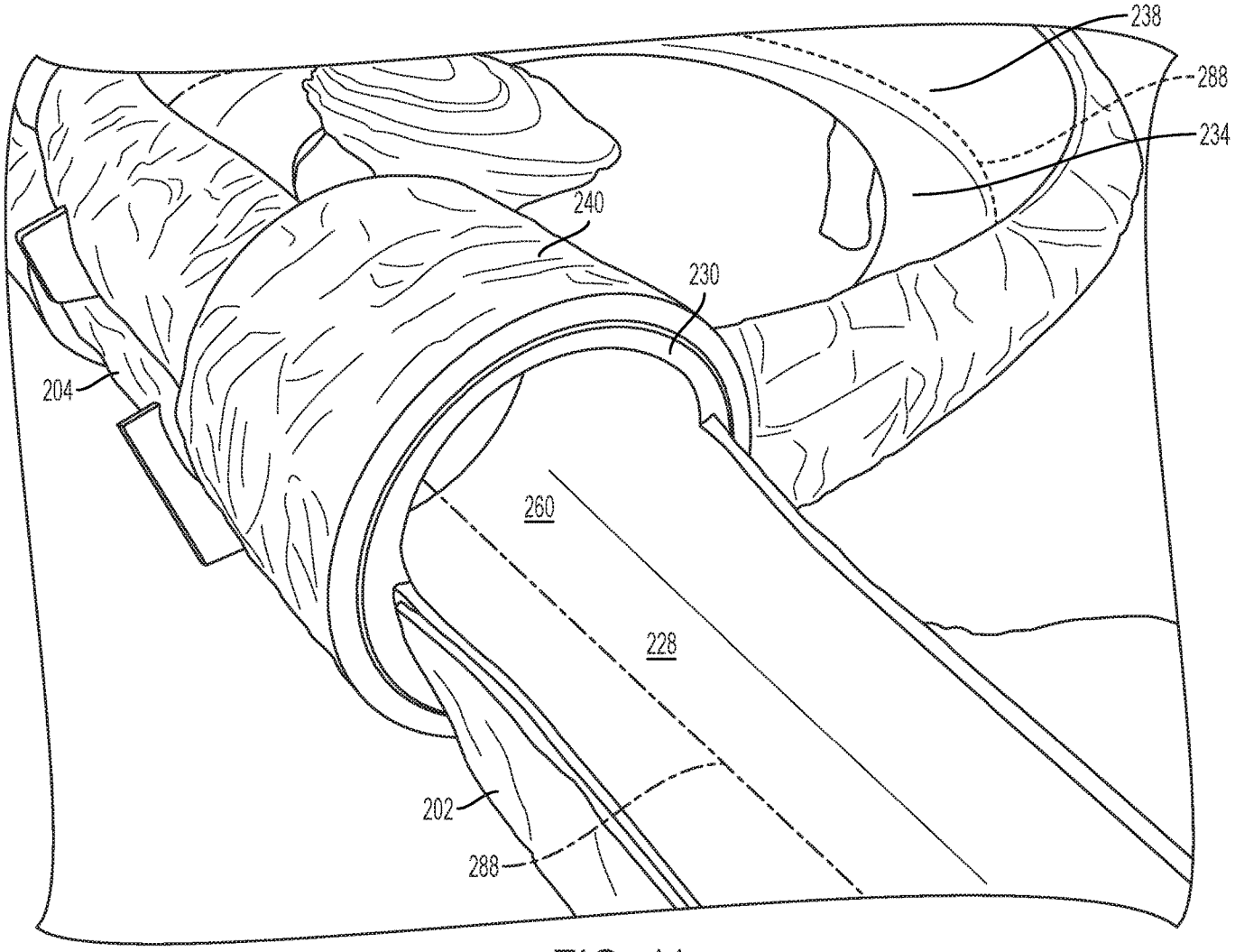
FIG. 11 is a perspective view of the toy track set of FIG. 9, showing a connection between a first track section and a second track section.
Figure 12:
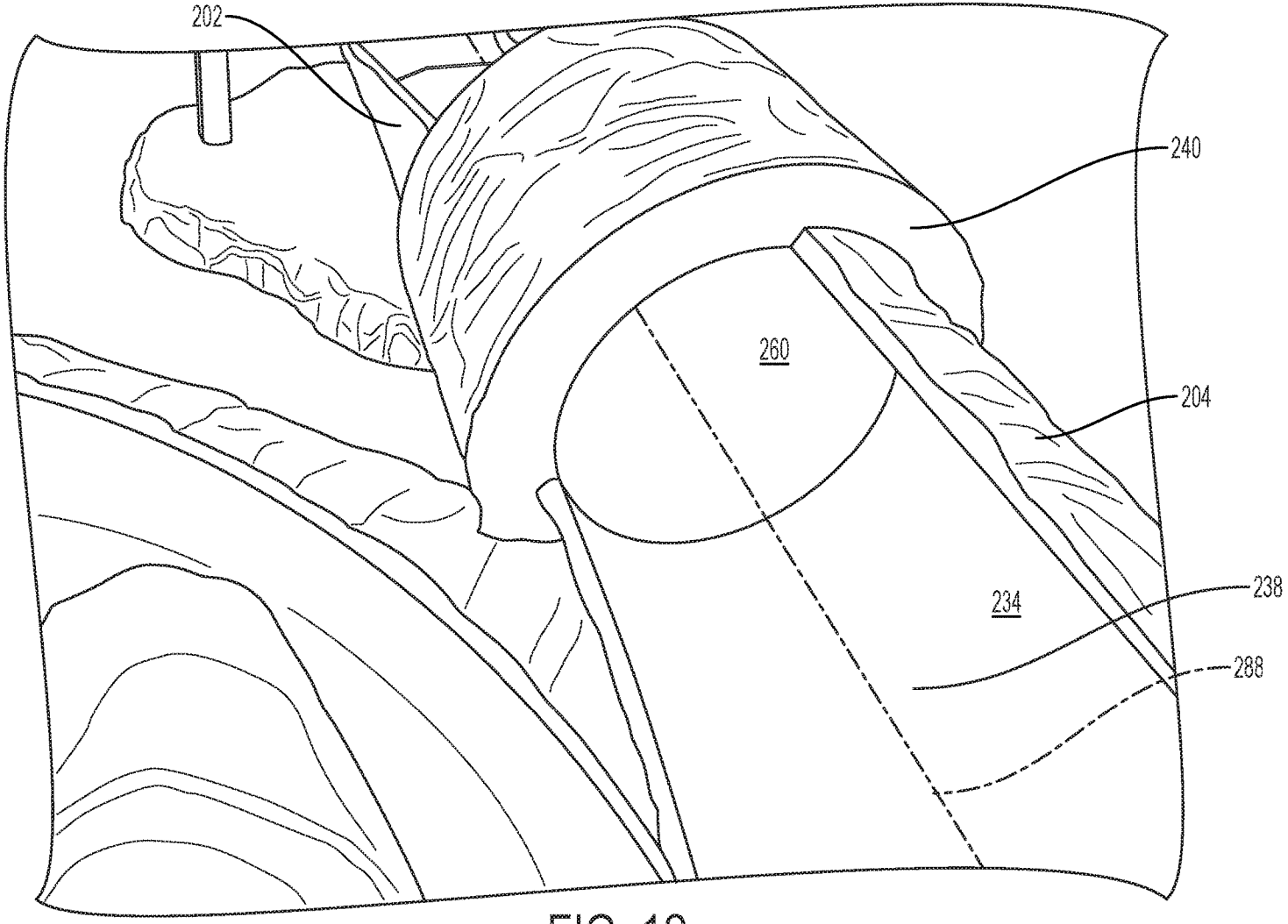
FIG. 12 is another perspective view of the toy track set of FIG. 9, showing the connection between the first track section and the second track section.

FIG. 11 is a detailed perspective view of a connection between first track section 202 and second track section 204. In particular, FIG. 11 shows first tubular connector 230 of the first track section rotatably coupled to second tubular connector 240 of the second track section. FIG. 12 is another detailed perspective view of the connection between the first track section and the second track section when the second track section is in the second position. FIGS. 11 and 12 are herein described together.

The second track section may move from the first position shown in, for example, FIG. 5 to the second position shown, for example, in FIG. 11 without disengaging first tubular connector 230 from second tubular connector 240. The rotatable coupling between the first and second tubular connectors may allow the second track section to take and remain in a plurality of positions between the first and second positions relative to the first track section.

Inner surface 260 of first tubular connector 230 may form continuous travel path 288 with first travel surface 228 and second travel portion 238 of second travel surface 234 in the second position. In the embodiment shown in FIGS. 11 and 12, first tubular connector 230 is received by second tubular connector 240 and inner surface 260 is contiguous with first travel surface 228. In an alternate embodiment, second tubular connector 240 may include inner surface 260 and the second tubular connector may be received by the first tubular connector. In this alternate embodiment, inner surface 260 may be contiguous with second travel surface 234. That is, one of the first and second cylindrical connectors 230 and 240 may include inner surface 260 that may be contiguous with one of the first and second travel surfaces.

Figure 13:
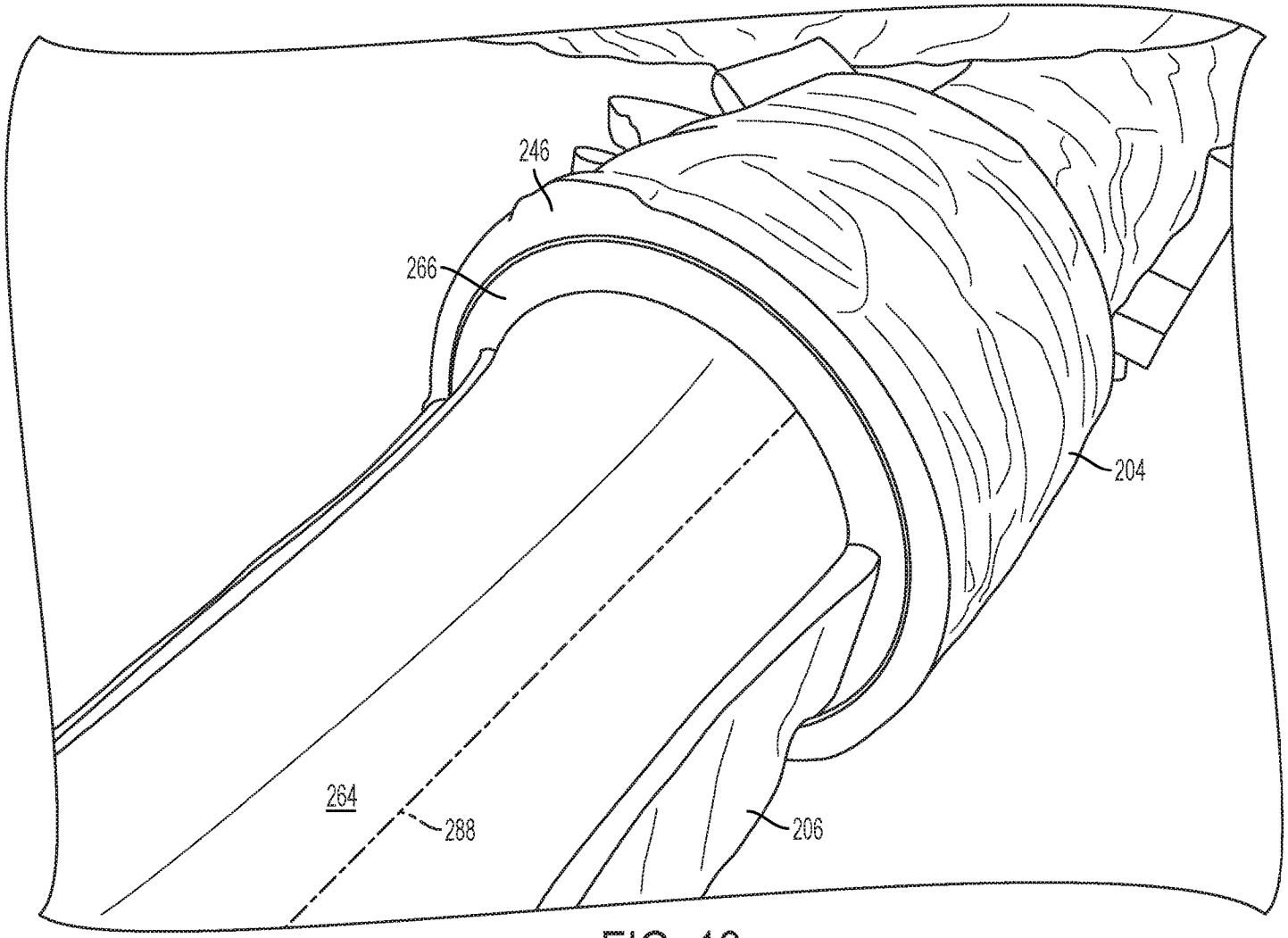
FIG. 13 is a perspective view of the toy track set of FIG. 9, showing a connection between the second track section and a third track section.

FIG. 13 is a detailed perspective view of a connection between second track section 204 and third track section 206, when the second track section is in the second position. In particular, FIG. 13 shows third tubular connector 246 of the second track section rotatably coupled to fourth tubular connector 266 of the third track section. When the second track section 204 is in the second position, third travel surface 264 of the third track section may form continuous travel path 288 with first travel surface 228 (see, for example, in FIG. 11), inner surface 260 (see, for example, in FIG. 11), and second travel portion 238 of second travel surface 234 (see, for example in FIG. 12). Third travel surface 264 may be contiguous with the second travel portion in the second position.

Example Features:

This section describes additional aspects and features of toy track sets, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing without limitation examples of some of the suitable combinations.

A1. A toy track set for a toy vehicle, comprising:

a first track section having a first travel surface and a first tubular connector at a first connecting end of the first travel surface; and a second track section that is configured to be rotatably coupled to the first tubular connector, the second track section includes a second travel surface having first and second travel portions, the second track section is configured to rotate relative to the first track section between a first position in which the first travel surface forms a continuous travel path with the first travel portion, and a second position in which the first travel surface forms a continuous travel path with the second travel portion.

A2. The toy track set of paragraph A1, wherein the second track section further includes a second tubular connector at a second connecting end of the second travel surface, the second tubular connector being configured to be rotatably coupled to the first tubular connector.

A3. The toy track set of paragraph A2, wherein the first and second tubular connectors are configured for frictional engagement with each other when the second tubular connector is rotatably coupled to the first tubular connector.

A4. The toy track set of any of paragraph A2-A3, wherein the first tubular connector has a first diameter and the second tubular connector has a second diameter, wherein the first diameter is less than the second diameter such that the first tubular connector is sized to be received within the second tubular connector.

A5. The toy track set of any of paragraphs A1-A4, wherein the first tubular connector includes an inner surface that is contiguous with the first travel surface, wherein the inner surface forms a continuous travel path with the first travel surface and the first travel portion of the second travel surface in the first position, and the inner surface forms a continuous travel path with the first travel surface and the second travel portion of the second travel surface in the second position.

A6. The toy track set of any of paragraphs A2-A5, wherein the second track section further includes a third tubular connector at a third connecting end of the second travel surface, the third connecting end is opposed from the second connecting end.

A7. The toy track set of paragraph A6, further comprising a third track section that is rotatably coupled to the third tubular connector, the third track section includes a third travel surface, the third travel surface forms a continuous travel path with the first travel surface, the inner surface, and the first travel portion of the second travel surface in the first position, and a continuous travel path with the first travel surface, the inner surface, and the second travel portion of the second travel surface in the second position.

A8. The toy track set of paragraph A7, wherein the third track section further includes a fourth tubular connector at a fourth connecting end of the third travel surface, the fourth tubular connector being configured to be rotatably coupled to the third tubular connector.

A9. The toy track set of any of paragraphs A1-A8, wherein the second travel surface has a lateral cross section that is concave-shaped with a bottom portion disposed between two curved portions.

A10. The toy track set of paragraph A9, wherein the first travel portion is along the bottom portion, and the second travel portion is along one of the two curved portions.

A11. The toy track set of any of paragraphs A1-A10, wherein the second travel surface forms a loop that is in a generally vertical orientation in the first position, and in a generally horizontal orientation in the second position.

A12. The toy track set of any of paragraphs A1-A11, wherein the first and second travel portions are parallel to each other.

B1. A toy track set for a toy vehicle, comprising:

a first track section having a first travel surface and a first cylindrical connector; and a second track section having a second travel surface and a second cylindrical connector, the second travel surface includes first and second travel portions, the second cylindrical connector is configured to be rotatably connected to the first cylindrical connector to allow the second track section to rotate relative to the first track sections between a first position in which the first travel surface is contiguous with the first travel portion and spaced from the second travel portion, and a second position in which the first travel surface is contiguous with the second travel portion and spaced from the first travel portion.

B2. The toy track set of paragraph B1, wherein the first cylindrical connector has a first diameter and the second cylindrical connector has a second diameter, wherein the first diameter is different from the second diameter to allow one of the first and second cylindrical connectors to be received in the other of the first and second cylindrical connectors.

B3. The toy track set of any of paragraphs B1-B2, wherein the first and second cylindrical connectors are configured to frictionally engage each other when rotatably connected.

B4. The toy track set of any of paragraphs B1-B3, wherein one of the first and second cylindrical connectors includes an inner surface that is contiguous with one of the first and second travel surfaces.

B5. The toy track set of any of paragraphs B1-B4, wherein the second track section further includes a third cylindrical connector.

B6. The toy track set of paragraph B5, further comprising a third track section that includes a third travel surface and a fourth cylindrical connector, the fourth cylindrical connector is configured to be rotatably connected to the third cylindrical connector, the third travel surface is contiguous with the first travel portion in the first position, and is contiguous with the second travel portion in the second position.

B7. The toy track set of any of paragraphs B1-B6, wherein the second travel surface has a lateral cross-section that is concave-shaped with a bottom portion disposed between two curved portions.

B8. The toy track set of paragraph B7, wherein the first travel portion is along the bottom portion, and the second travel portion is along one of the two curved portions.

B9. The toy track set of any of paragraphs B1-B8, wherein the second travel surface forms a loop that is in a vertical orientation in the first position, and in a horizontal orientation in the second position.

C1. A toy track set for a toy vehicle comprising:

a first track section including a first travel surface and a first tubular connector at a connecting end of the first travel surface, the first tubular connector having a first radius, the first travel surface contiguous with an inside surface of the tubular connector;

a second track section including a second travel surface and a second tubular connector at a connecting end of the second travel surface, the second travel surface having a cross section with a concave curvature, the second tubular connector having a second radius different than the first radius, the second travel surface engaging with at least 180 degrees of one opening of the second tubular connector; and the first tubular connector and the second tubular connector are configured for a frictional engagement with each other in a connected configuration, where the first track section and the second track section are rotatable with respect to each other between a horizontal and an offset configuration when the first tubular connector and the second tubular connector are in the connected configuration, and the first travel surface and the second travel surface are functionally contiguous in both the horizontal and the offset configuration.

Advantages, Features, Benefits

The different embodiments of the toy track sets for toy vehicles described herein provide several advantages over known toy track sets. For example, the illustrative embodiments of toy track sets described herein allow for a loop section of the track to be selectively oriented vertically or horizontally without separation of the components of the set during the reconfiguration. Additionally, and among other benefits, illustrative embodiments of the toy track sets described herein allow for rotatable connection between adjacent track sections. No known system or device can perform these functions. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A toy track set for a toy vehicle, comprising:

a first track section having a first travel surface and a first tubular connector at a first connecting end of the first travel surface; and a second track section that is configured to be rotatably coupled to the first tubular connector, the second track section includes a second travel surface having first and second travel portions, the second track section is configured to rotate relative to the first track section between a first position in which the first travel surface forms a continuous travel path with the first travel portion, and a second position in which the first travel surface forms a continuous travel path with the second travel portion.

2. The toy track set of claim 1, wherein the second track section further includes a second tubular connector at a second connecting end of the second travel surface, the second tubular connector being configured to be rotatably coupled to the first tubular connector.

3. The toy track set of claim 2, wherein the first and second tubular connectors are configured for frictional engagement with each other when the second tubular connector is rotatably coupled to the first tubular connector.

4. The toy track set of claim 2, wherein the first tubular connector has a first diameter and the second tubular connector has a second diameter, wherein the first diameter is less than the second diameter such that the first tubular connector is sized to be received within the second tubular connector.

5. The toy track set of claim 4, wherein the first tubular connector includes an inner surface that is contiguous with the first travel surface, wherein the inner surface forms a continuous travel path with the first travel surface and the first travel portion of the second travel surface in the first position, and the inner surface forms a continuous travel path with the first travel surface and the second travel portion of the second travel surface in the second position.

6. The toy track set of claim 2, wherein the second track section further includes a third tubular connector at a third connecting end of the second travel surface, the third connecting end is opposed from the second connecting end.

7. The toy track set of claim 6, further comprising a third track section that is rotatably coupled to the third tubular connector, the third track section includes a third travel surface, the third travel surface forms a continuous travel path with the first travel surface, the inner surface, and the first travel portion of the second travel surface in the first position, and a continuous travel path with the first travel surface, the inner surface, and the second travel portion of the second travel surface in the second position.

8. The toy track set of claim 7, wherein the third track section further includes a fourth tubular connector at a fourth connecting end of the third travel surface, the fourth tubular connector being configured to be rotatably coupled to the third tubular connector.

9. The toy track set of claim 1, wherein the second travel surface has a lateral cross section that is concave-shaped with a bottom portion disposed between two curved portions.

10. The toy track set of claim 9, wherein the first travel portion is along the bottom portion, and the second travel portion is along one of the two curved portions.

11. The toy track set of claim 1, wherein the second travel surface forms a loop that is in a generally vertical orientation in the first position, and in a generally horizontal orientation in the second position.

12. The toy track set of claim 1, wherein the first and second travel portions are parallel to each other.

13. A toy track set for a toy vehicle, comprising:

a first track section having a first travel surface and a first cylindrical connector; and a second track section having a second travel surface and a second cylindrical connector, the second travel surface includes first and second travel portions, the second cylindrical connector is configured to be rotatably connected to the first cylindrical connector to allow the second track section to rotate relative to the first track section between a first position in which the first travel surface is contiguous with the first travel portion and not contiguous with the second travel portion, and a second position in which the first travel surface is contiguous with the second travel portion and not contiguous with the first travel portion.

14. The toy track set of claim 13, wherein the first cylindrical connector has a first diameter and the second cylindrical connector has a second diameter, wherein the first diameter is different from the second diameter to allow one of the first and second cylindrical connectors to be received in the other of the first and second cylindrical connectors.

15. The toy track set of claim 13, wherein the first and second cylindrical connectors are configured to frictionally engage each other when rotatably connected.

16. The toy track set of claim 13, wherein one of the first and second cylindrical connectors includes an inner surface that is contiguous with the first travel surface and the first travel portion in the first position, and with the first travel surface and the second travel portion in the second position.

17. The toy track set of claim 13, wherein the second track section further includes a third cylindrical connector.

18. The toy track set of claim 17, further comprising a third track section that includes a third travel surface and a fourth cylindrical connector, the fourth cylindrical connector is configured to be rotatably connected to the third cylindrical connector, the third travel surface is contiguous with the first travel portion in the first position, and is contiguous with the second travel portion in the second position.

19. The toy track set of claim 13, wherein the second travel surface has a lateral cross-section that is concave-shaped with a bottom portion disposed between two curved portions.

20. The toy track set of claim 19, wherein the first travel portion is along the bottom portion, and the second travel portion is along one of the two curved portions.

* * * * *